US007112067B1

(12) United States Patent
Korsunsky et al.

(10) Patent No.: US 7,112,067 B1
(45) Date of Patent: Sep. 26, 2006

(54) CONNECTOR ASSEMBLY FOR PRINTED CIRCUIT BOARD INTERCONNECTION

(75) Inventors: Iosif R. Korsunsky, Harrisburg, PA (US); Joanne E. Shipe, Harrisburg, PA (US); James H. Hyland, Hummelstown, PA (US); Peter T. Graustein, Elizabethtown, PA (US); Robert W. Brown, Harrisburg, PA (US)

(73) Assignee: Hon Hai Precision Ind. Co., LTD, Taipei Hsien (TW)

( * ) Notice: Subject to any disclaimer, the term of this patent is extended or adjusted under 35 U.S.C. 154(b) by 66 days.

(21) Appl. No.: 11/104,196

(22) Filed: Apr. 11, 2005

(51) Int. Cl.
*H01R 12/00* (2006.01)

(52) U.S. Cl. ..... 439/65; 439/76.1

(58) Field of Classification Search ..... 439/65, 439/66, 74, 75, 76.1
See application file for complete search history.

(56) References Cited

U.S. PATENT DOCUMENTS 4,133,592 A * 1/1979 Cobaugh et al. ..... 439/74
4,695,106 A * 9/1987 Feldman et al. ..... 439/83
5,704,795 A * 1/1998 Lindeman ..... 439/66
5,823,795 A * 10/1998 Schumacher ..... 439/76.1
5,833,475 A * 11/1998 Mitra ..... 439/79
6,012,927 A * 1/2000 Longueville et al. ..... 439/65
2004/0114334 A1* 6/2004 Korsunsky et al. ..... 361/733

* cited by examiner

*Primary Examiner*—James R. Harvey
(74) *Attorney, Agent, or Firm*—Wei Te Chung

(57) ABSTRACT

A connector assembly (1) used to interconnect a primary circuit board (4) to an intermediate circuit board (5) includes a one-piece insulated housing (2) and an outer shell (3) partially enclosing outside of the housing (2). The housing (2) has a space (20) formed from a mounting side of the housing (2) to the primary circuit board (4) and a face (22) formed at another mounting side of the housing (2) to the intermediate circuit board (5). A plurality of conductors (25) is retained in the housing and extends from the space (20) to the face (22) and each conductor (25) has one tail portion (251) to be press-fit on the intermediate circuit board (5) and another tail portion to be engaged with a corresponding hole (41) on the primary circuit board (4). The one-piece housing and fewer interfaces are used, and the mounting method and mechanism of the conductors is simplified to reduce the cost of manufacturing.

7 Claims, 9 Drawing Sheets

CONNECTOR ASSEMBLY FOR PRINTED CIRCUIT BOARD INTERCONNECTION

CROSS-REFERENCE TO RELATED APPLICATION

This application is related to U.S. patent application Ser. No. 10/318,502, filed Dec. 12, 2002.

BACKGROUND OF THE INVENTION

1. Field of the Invention

The present invention is related to a connector assembly having contacts with high density arrangement so as to interconnect two printed circuit boards or modularized circuit board assemblies, especially to a connector assembly having a simple and facilely assembled mounting interface for connecting daughter board assembly to a motherboard.

2. Description of Prior Arts

In a specialized backplane assembly of a computation or communication device, a primary circuit board is used to connect other intermediate circuit boards or extension cards to achieve different electronic functions or performance. In most situations, more extension cards are needed to connect to the primary circuit board via one of the intermediate (secondary) circuit boards/extension cards in order to provide repeated electronic function. It is understood that high density interconnection between the primary circuit board and the one intermediate circuit board will become necessary so that all the extension cards mounted on the one intermediate circuit board can effectively and efficiently communicate with the primary circuit board via the high density interconnection. Conventionally, a set of plug and receptacle connectors is considerable to be adapted for connecting the primary circuit board and the one intermediate circuit board. At least three interfaces have to be considered in this interconnection, a mating interface between the plug and receptacle connectors and two mounting interfaces for the plug and receptacle connectors respectively to circuit boards where they are seated. Czeschka U.S. Pat. Nos. 4,959,024 and 6,129,591, Niitsu et al. U.S. Pat. No. 5,735,696 and Wang U.S. Pat. No. 5,919,063 all show different interfaces of a plug connector and a receptacle connector for mating and mounting. Obviously, both plug and receptacle connectors have contacts with a specialized shape of their own. To guarantee the reliable engagement between the mating plug contact and receptacle contact, enough engaging area and interaction force should be provided by the contacts when the connectors are mated. And a reliable mounting joint, usually a soldered one, between ever plug or receptacle contact and circuit board is very important too for better electrical performance. To sum up, interconnection of two separate connectors, including a plug and a receptacle, needs twice the manufacturing and assembly processes to make the component connectors and double the processes to mount them onto the corresponding circuit boards. Therefore, the conventional connector designs will have a high cost for the type of application.

Additionally, in the compact arrangement of the intermediate circuit board, limited space is available to receive electronic components and smaller pitches between contacts restrain possible variations of size and shape of the connectors of their parts, especially the intermediate circuit board having lots of extension cards installed thereon. Thus, simplified connector parts are preferred to reduce the occupied space of the connectors. Obviously, complicated mating of mounting mechanism the conventional plug and receptacle connectors have is not the best choice for a compact arranged intermediate circuit board.

SUMMARY OF THE INVENTION

Therefore, an object of the present invention is to provide a connector assembly having the least connector parts to electrically connect a primary circuit board to other intermediate circuit boards/extension cards in a backplane application so as to reduce the number of needed interconnecting interfaces of the connector assembly and simplify the installation process of the connector.

Another object of the present invention is to provide a connector assembly having a simplified mounting mechanism to circuit boards to effectively save the occupied space of the circuit boards where the connector assembly is seated respectively.

Another object of the present invention is to provide a connector assembly having conductors with a consistent mechanism and engaging method, therefore all of the conductors can be easily made by similar producing processes to reduce the cost of manufacturing.

To obtain the above objects, a connector assembly in accordance with the present invention includes a one-piece insulated housing and an outer shell partially enclosing outside of the housing. The housing has a space formed from a mounting side of the housing toward the primary circuit board and a face formed at another mounting side of the housing toward the intermediate circuit board. A plurality of conductors is retained in the housing and extends from the space to the face and each conductor has one tail portion to be press-fit on the intermediate circuit board and another tail portion to be engaged with a corresponding hole on the primary circuit board. The one-piece housing and fewer interfaces of the connector assembly are used, and the mounting method and mechanism of the conductors is simplified to reduce the cost of manufacturing.

Another embodiment of the present invention is featured with the same mounting mechanism to all of the circuit boards. Each conductor installed in the connector assembly is L-shaped and has a press-fit type tail portion formed at each end of the conductor. Besides, every conductor is installed into two housing parts of the connector assembly from its two ends respectively so as to put these two housing parts together at the same time. The tail portions of every conductor can be press-fit in holes of the primary and intermediate circuit boards respectively to electrically connect thereto without the help of screws.

Another embodiment of a connector assembly in accordance with the present invention comprises at least two connector parts. Each connector part has a plurality of conductors installed therein, and conductors of different connector parts are adapted to be mounted onto the circuit boards or mated with each other in a similar way and mechanism. The manufacturing cost of conductors of the connector assembly can be effectively reduced.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
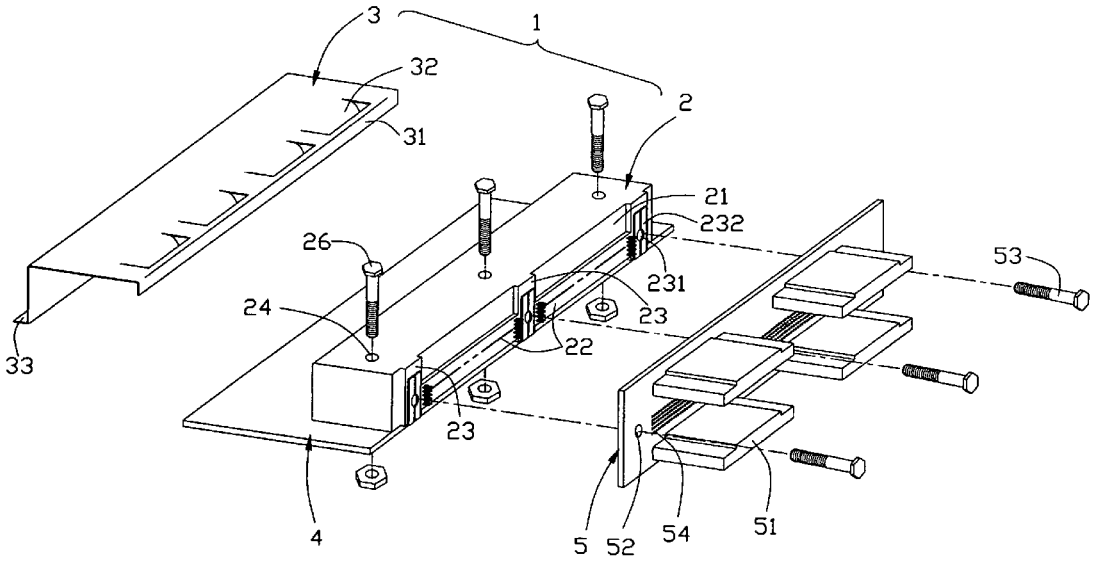
FIG. 1 is an exploded view of a connector assembly in accordance with the present invention showing the connector assembly is mounted on a primary circuit board and an intermediate circuit board respectively.
Figure 2:
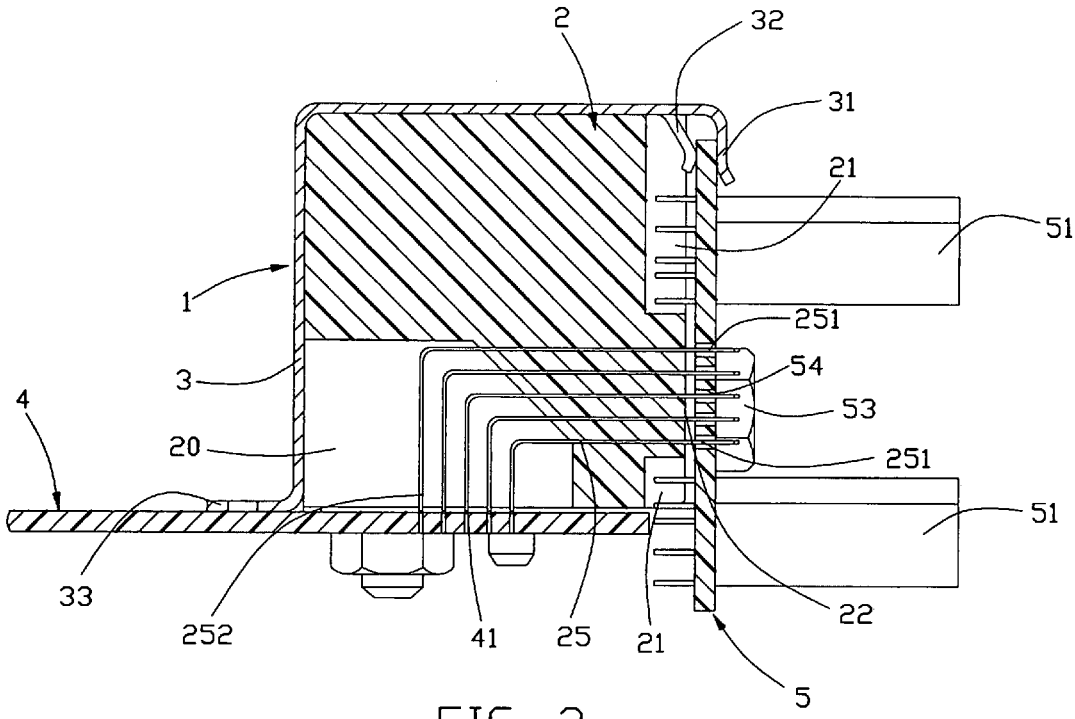
FIG. 2 is a sectional view of the connector assembly as shown in FIG. 1 in accordance with the present invention.

Referring to FIGS. 1 and 2, the connector assembly 1 in accordance with a first embodiment of the present invention is shown to be seated on a primary circuit board 4 of a backplane assembly and be going to be mounted on an intermediate (secondary) circuit board 5 having a plurality of connectors 51 disposed thereon to electrically connect with corresponding extension cards (not shown). The connector assembly 1 includes an insulated housing 2 and an outer shell 3 enclosing outside of the housing 2. The housing 2 has a first side abutting against the surface of the primary circuit board 4 when the connector assembly 1 is seated on the board 4. A space 20 is formed inside the housing 2 and has an opening formed on the first side. Meanwhile, a face 22 having a plurality of holes formed thereon is located at a second side of the housing 2 neighboring the first side. Recesses 21 are formed at the second side of the housing 2 next to the face 22. And several protrusions 23 extending vertically to the extending direction of the face 22 are located the second side next to the face 22 and each has a central screw hole 231 formed thereon. Two halves of an L-shaped metal piece 232 is partially placed on each protrusion 23 while other portions of the metal piece 232 extend upon the first side. A hole corresponding to the central screw hole of each protrusion 23 is formed by two halves of the metal piece 232 and another similar hole (not shown) is formed on the same metal piece 232 next to the first side of the housing 2. The second hole of the metal piece 232 is located in a position where a screw hole 24 extends and perforates through the housing 2 to the opposing side of the first side. A plurality of conductors 25 is received in the housing 2 by extending through their corresponding passageways formed in the housing 2 and extending from the face 22. The main body of each conductor 25 is retained in the corresponding passageway. One tail portion 251 at one end of the conductor is formed as a press-fit end and extends out of the face 22 in order to be fixedly inserted in a corresponding plated hole 54 of a hole array formed on the intermediate circuit board 5. Meanwhile, the other tail portion 252 at the other end of the conductor 25 extends from the passageway into the space 20 and becomes a resilient L-shaped cantilever beam. The distal end of the tail portion 252 is wedge-shaped so as to be partially inserted into one gold-plating hole 41 of a hole array formed on the primary circuit board 4 and establish electrical transmission path therebetween. In addition, the EMI outer shell 3 is a stamped metal plate and has at least two plane portions vertical to each other. A tab portion 31 is formed on one free edge of one plane portion and a number of lanced-out portions 32 are formed on the plane portion next to the tab portion 31 and arranged in a line so that the tab portion 31 and its neighboring lanced-out portions 32 can form a clip-like mechanism together. A tab-like tail portion 33 of the outer shell 3 is formed on one free edge of the other plane portion so as to be mounted on or abut against the surface of the primary circuit board 4.

Referring particularly to FIG. 2, when the connector assembly 1 is assembled and going to be mounted onto the primary circuit board 4 and intermediate circuit board 5, the housing 2 of the connector assembly 1 is first placed onto the intermediate circuit board 5 with its face 22 abutting against the surface of the intermediate circuit board 5, and at the same time press-fit tail portions 251 of conductors 25 extending beyond the face 22 are inserted fixedly in the array of holes 54 of the intermediate circuit board 5 so as to establish electrical connection to the intermediate circuit board 5. Screws 53 then can be used to fix the intermediate circuit board 5 and the housing 2 together by having the screws 53 passing through holes 52 formed on the intermediate circuit board 5 and being fixedly inserted into the screw holes 231 respectively. Each screw 53 is mechanically fixed in screw hole 231 of the protrusion 23 and the corresponding metal piece 232 surrounding the screw hole 231 will engage simultaneously with a solder pad (not shown) on the intermediate circuit board 5 for power or ground use. Recesses 21 beside the face 22 are used to receive possible extending tails of the connectors mounted on the intermediate circuit board 5. Afterwards, the housing 2 can be placed on the primary circuit board 4 with all of cantilever-beam tail portions 252 of conductors 25 being aligned with the array of holes 41 on the primary circuit board 4. Several screws 26 and corresponding nuts (not labeled) are used to fix the housing 2 to the primary circuit board 4 via screw holes 24 of the housing 2 and the metal pieces 232 can engage with these screws 26 for ground purpose. Due to the fact that the tail portion 252 of every conductor 25 is a resilient cantilever beam and extends out of the space 20 of the housing 2 before the housing 2 is mounted onto the primary circuit board 4, and the screwed force applied onto the housing 2, the distal end of every tail portion 252 will be effectively and firmly engaged with and partially inserted in the corresponding gold-plating hole 41 to establish electrical connection between the connector assembly 1 and the primary circuit board 4. After the housing 2 is firmly mounted on the primary and intermediate circuit boards 4, 5 respectively, the outer shell 3 can be installed onto the housing 2 by using its clip-like tap portion 31 and lance-out portions 32 to clamp the top edge of the intermediate circuit board 5 and its tail portion 33 to be soldered or screwed on the primary circuit board 4. Of course, a ground transmission path can be established by means of the outer shell 3 too.

It is understandable that only one-piece housing 2 of the connector assembly 1 is used in this embodiment. Therefore only two mounting interfaces for the connector assembly 1 are formed around the first and second sides of the housing 2. Conductors 25, installed and fixed in the housing 2 from the rear of the space 20, are made in the same style and method to be mounted onto the primary and intermediate circuit boards 4, 5 so that the mounting process of the connector assembly 1 can be successfully simplified and become very efficient. Additionally, the manufacturing cost and time of the connector assembly 1 is saved at the same time due to fewer interfaces and conductors the connector assembly 1 has.

Figure 3:
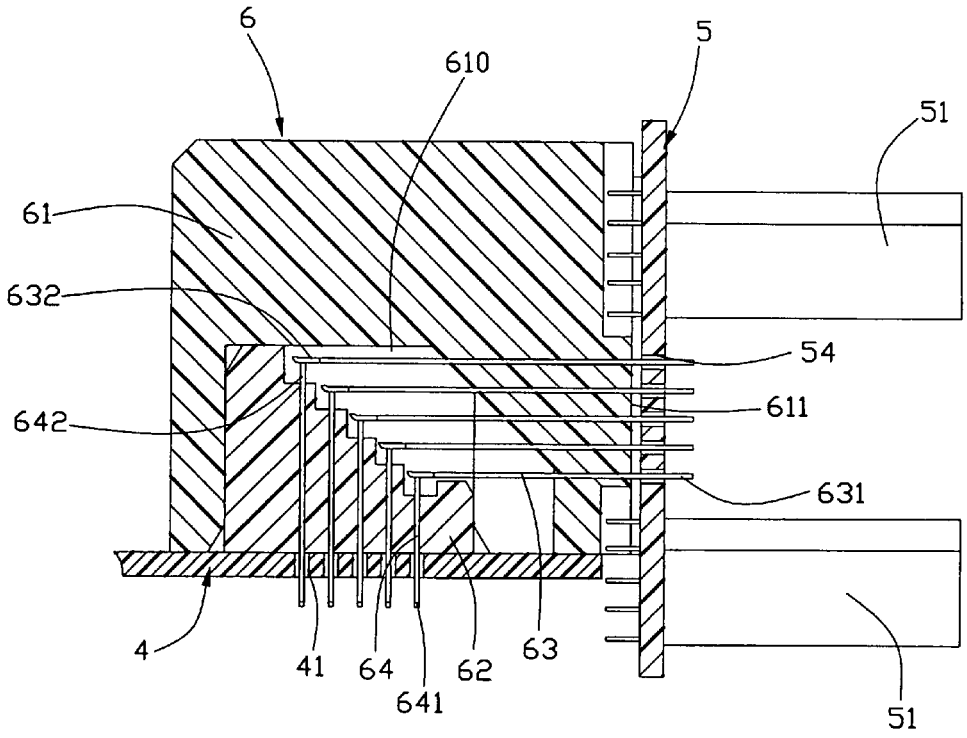
FIG. 3 is a sectional view of a connector assembly in accordance with a second embodiment of the present invention.
Figure 4A:
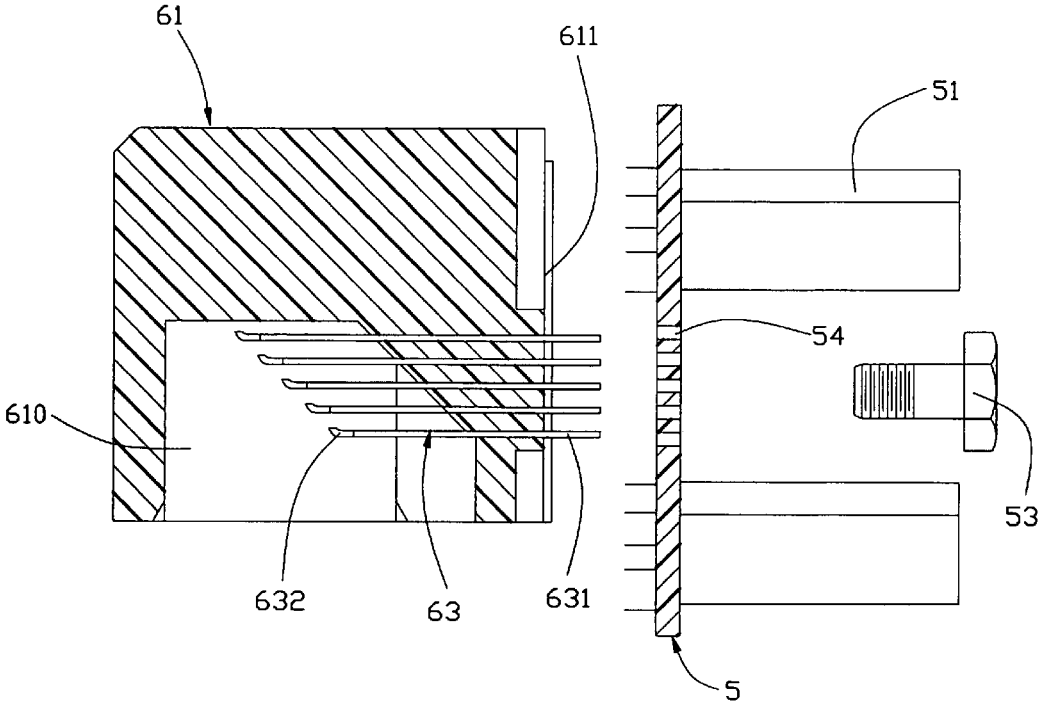
FIGS. 4A and 4B are sectional views of the connector assembly of the second embodiment as shown in FIG. 3 showing the mounting and mating processes of two connector parts of the connector assembly.
Figure 4B:
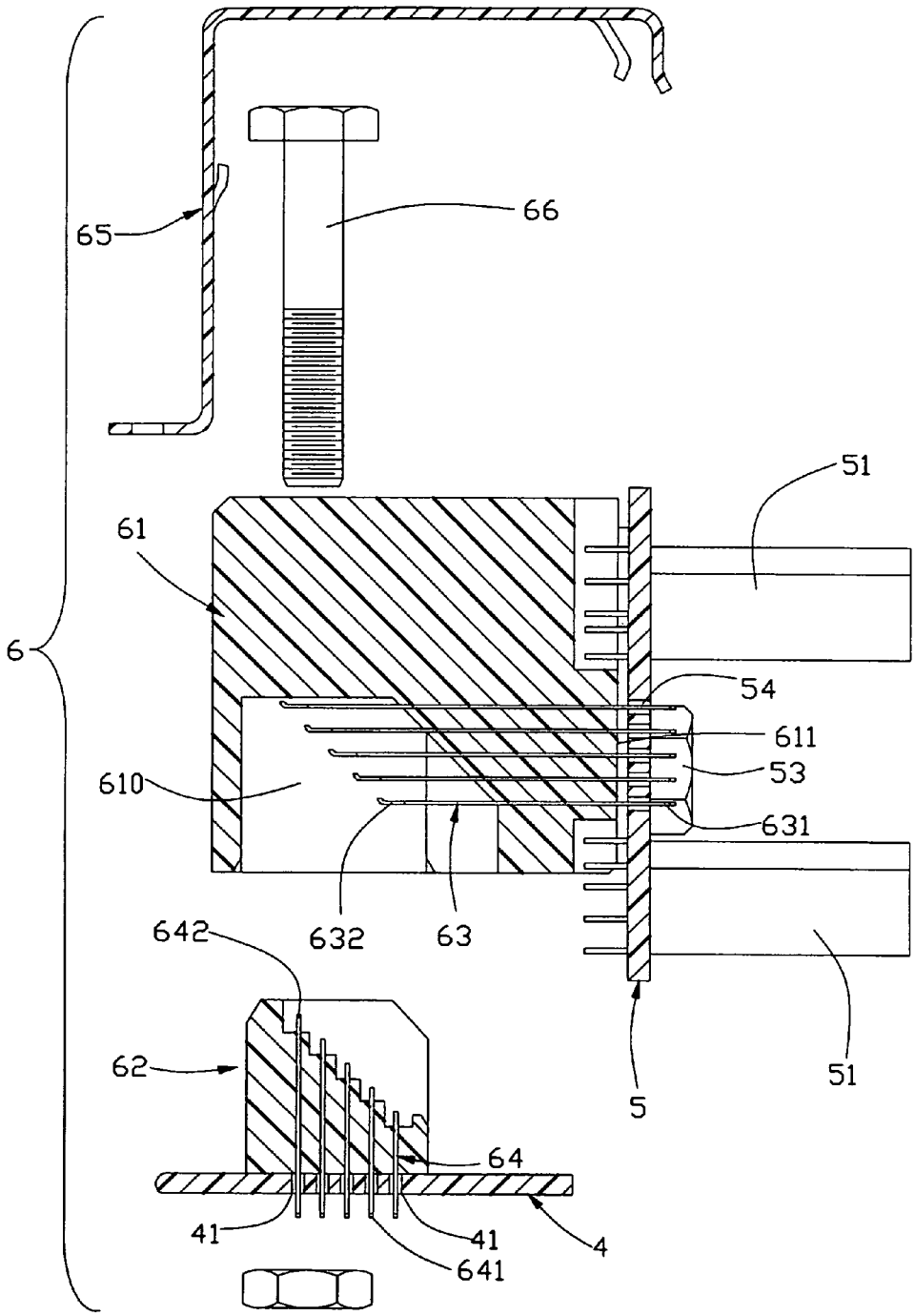

Referring to FIGS. 3 and 4A, 4B, a second embodiment of the connector assembly 6 in accordance with the present invention is shown to be mounted on the primary and intermediate circuit boards 4, 5. The connector assembly 6 includes an insulated first connector part 61 and an insulated second connector part 62. A space 610 is formed from one side of the first connector part 61 and a plurality of first conductors 63 is installed beside the space 610 to have one tail portion 632, usually having a flatting-shaped end, of every first conductor 63 extending into the space 610 and the other tail portion 631, usually having a press-fit end, extending beyond a face 611 formed at another side of the first connector part 61. On the other hand, the second connector part 62 is adapted to be fully inserted into the space 610. One side of the second connector part 62 is continuously stair-like face, and its opposing side is used to abut against the surface of the primary circuit board 4 and is flushed with the side of the first connector part 61 having the space 610. A plurality of second conductors 64 is installed in the second connector part 62, and each of them includes a press-fit tail portion 641 extending out of the abutting side of the second connector part 62 and a blade-ended tail portion 642 extending beyond the stair-like face of the second connector part 62. Obviously, when the connector assembly 6 is assembled and mounted, the first connector part 61 is first mounted onto the intermediate circuit board 5 to have the tail portions 631 of the first conductors 63 fixedly inserted in the holes 54 of the intermediate circuit board 5 with the help of screws 53. And then the second connector part 62 is mounted on the primary circuit board 4 with tail portions 641 of the second conductors 64 engaged with the holes 41 of the primary circuit board 4. Afterwards, the first and second connector parts 61, 62 are mated with each other while the other tail portions 632 of the first conductors 63 are respectively engaged with the other tail portions 642 of the second conductors 64 above the stair-like face of the second connector part 62 by means of the help of another screws 66. The flexibility of every tail portion 632 of the first conductor 63 to the tail portion 642 of the second conductor 64 will guarantee the reliability of conductor engagement. Finally a shell 65 similar to the first embodiment is installed to partially enclose the first and second connector parts 61, 62. Again, simplified mating and mounting methods are adopted though more interfaces are used. And similar conductors 63, 64 are used in these two connector parts 61, 62 so as to facilitate the manufacture of the conductors 63, 64.

Figure 5:
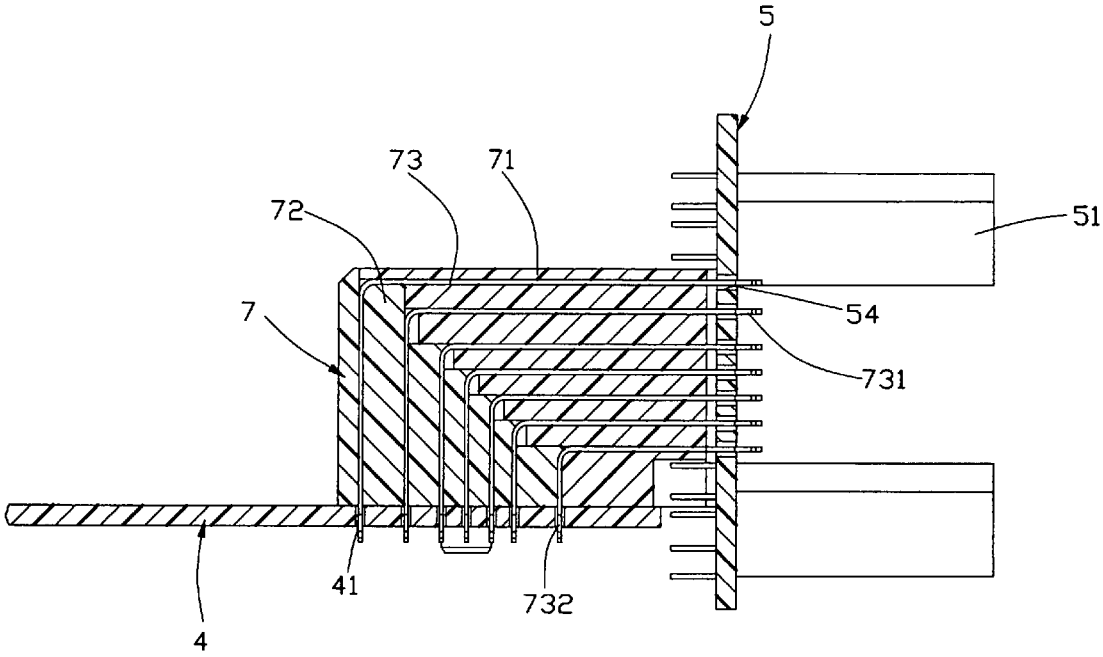
FIG. 5 is a sectional view of a connector assembly in accordance with a third embodiment of the present invention.
Figure 6:
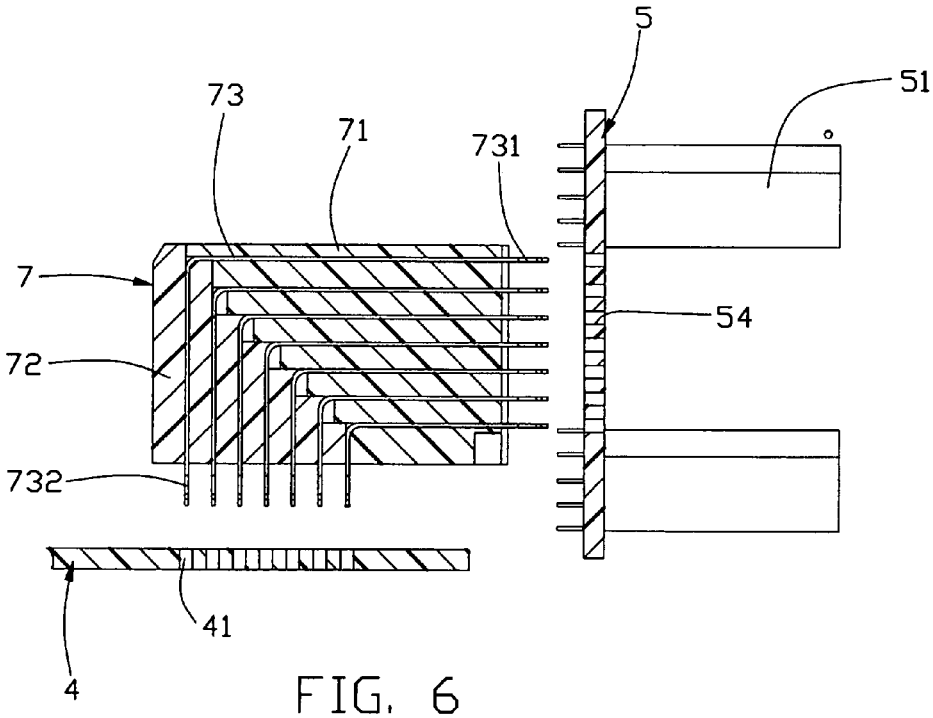
FIG. 6 is a sectional view of the connector assembly of the third embodiment as shown in FIG. 5 showing the mounting process of the connector assembly.

Referring to FIGS. 5 and 6, a third embodiment of the connector assembly 7 in accordance with the present invention is shown to be mounted on the primary and intermediate circuit boards 4, 5. The connector assembly 7 is very similar to the first embodiment except its two-piece housing and different conductor connection. Each conductor 73 of the connector assembly 7 is L-shaped and has a press-fit type tail portion 731, 732 formed at each end of the conductor 73. And every conductor 73 is installed into two housing parts 71, 72 of the connector assembly 7 respectively so as to put these two housing parts together at the same time. Then, the tail portions 731, 732 of every conductor 73 can be press-fit in holes 41, 54 of the primary and intermediate circuit boards 4, 5 respectively to electrically connect thereto. It is understood that the convenient advantages of the first embodiment can be achieved by this embodiment too. And this embodiment can work without the help of screws.

Figure 7:
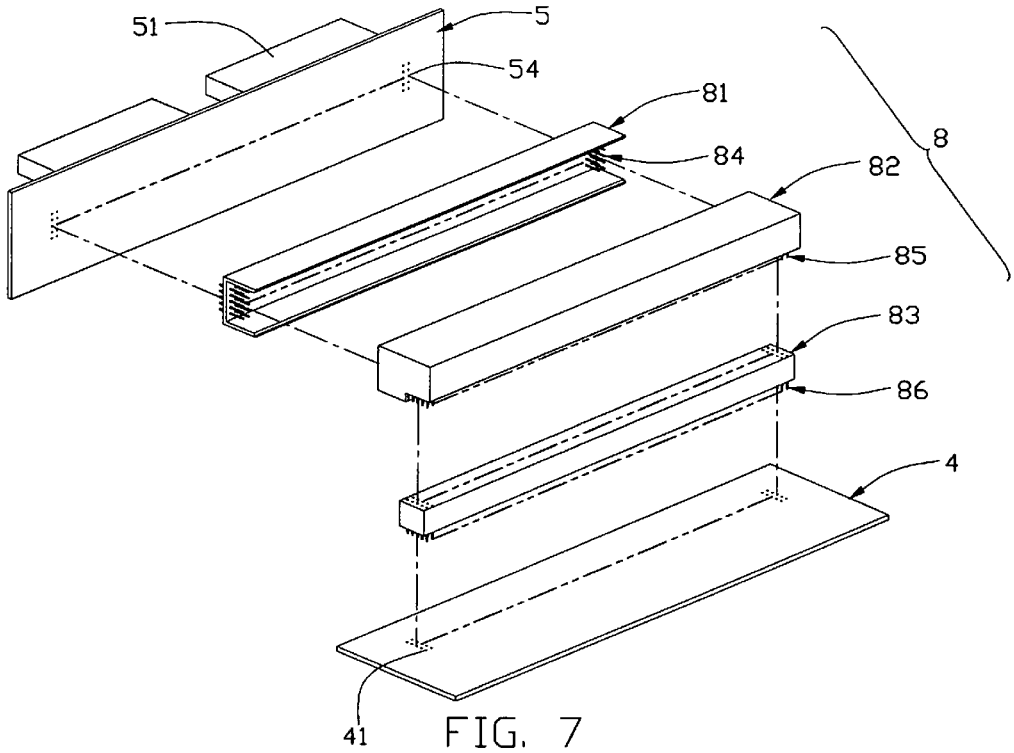
FIG. 7 is an exploded view of a connector assembly in accordance with a fourth embodiment of the present invention showing the connector assembly mounted on a primary circuit board and an intermediate circuit board respectively.
Figure 8:
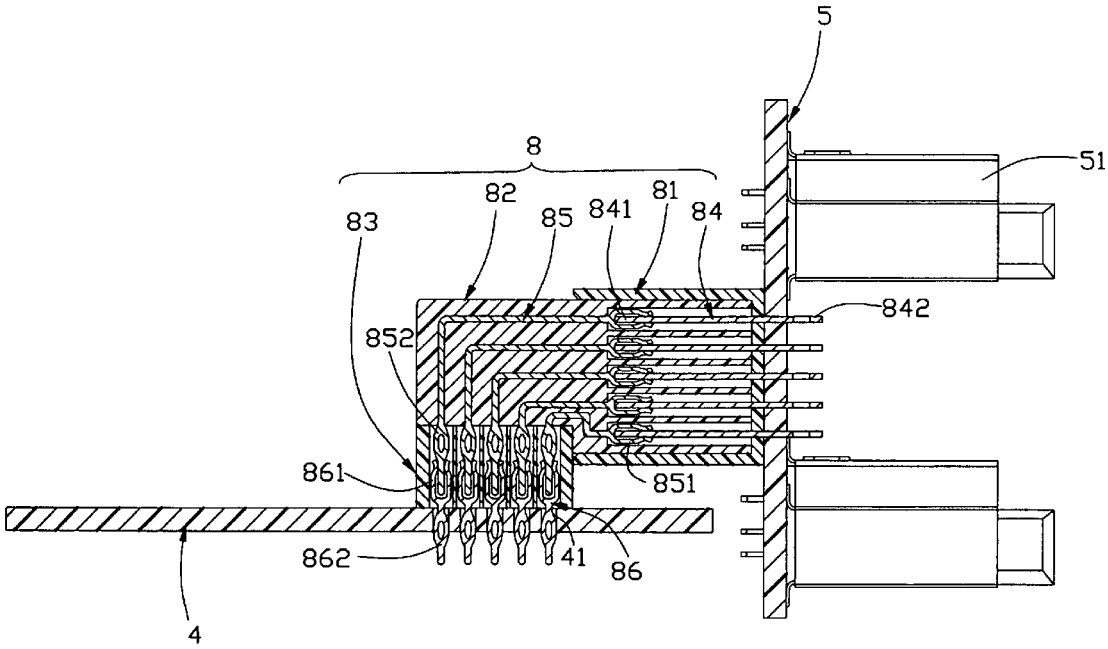
FIG. 8 is a sectional view of the connector assembly of the fourth embodiment as shown in FIG. 7 showing the mating and mounting processes of the connector assembly.

Referring again to FIGS. 7 and 8, a fourth embodiment of the connector assembly 8 in accordance with the present invention is shown to be mounted on the primary and intermediate circuit boards 4, 5. The connector assembly 8 includes a first connector part 81 with a plurality of first conductors 84 installed therein, a second connector part 82 with a plurality of second conductors 85 installed therein and a third connector part 83 with a plurality of third conductors 86 installed therein. At one end of every first, second and third conductor 84, 85, 86, a press-fit type tail portion 842, 852, 862 is formed, and at the other end of every second and third conductor 85, 86, a fork-typed tail portion 851, 861 is formed while a pin-like tail portion 841 at the other end of every first conductor 84. Every fork-typed tail portion 851 of the second conductor 85 can engage with the pin-like tail portion 841 of the first conductor 84 while every fork-typed tail portion 861 of the third conductor 86 can engage with the press-fit type tail portion 852 of the second conductor 85. The connector assembly 8 therefore is able to be mounted on the primary and intermediate circuit boards 4, 5 by using the compliant tail portions 842, 862 of the first and third conductors 84, 86 after the first, second and third connector parts 84, 85, 86 are mated with each other sequentially to form the whole connector assembly 8. Similarly to the second embodiment, the advantageously simplified mating and mounting methods are adopted and all of the conductors 84, 85, 86 have a similar shape and engaging mechanism. Both of them help to reduce possible cost for producing parts of the connector assembly 8.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

a first and second connector part each being mounted on one of a primary or a secondary circuit board, said first connector part having a mounting side abutting against the secondary circuit board and said second connector part having amounting side abutting against the primary circuit board;

a group of first conductors being received in said first connector part while another group of second conductors being received in said second connector part;

each first and second conductor having one tail portion to be mounted on the circuit boards respectively, and a first contact tail portion of said first conductor engaging with a second contact tail portion of said second conductor; wherein the one tail portion for board mounting of said first and second conductor has identical shape and functional mechanism, and the first contact and second contact tail portion of said first and second conductor have the same functional mechanism; wherein a first fastener passing through the primary circuit board and the first connector part in a first direction and a second fastener passing through the second circuit board and terminating within the first connector part in a direction transverse to the first direction.

2. The connector assembly as recited in claim 1, wherein the one tail portion of said first and second conductor is a press-fit type to be fully inserted in a metalized hole of the primary and secondary circuit board respectively.

3. The connector assembly as recited in claim 1, wherein the first contact tail portion of said first conductor is a resilient blade type to be flexibly engaged with the second contact tail portion.

4. The connector assembly as recited in claim 1, wherein connector assembly further comprises a third connector part having a group of third conductors, two tail portions are formed at two ends of each third conductor respectively.

5. The connector assembly as recited in claim 4, wherein one tail portion of said third conductor is identical to the one tail portion of said first conductor while the third contact tail portion of said third conductor is identical to the second contact tail portion of said second conductor.

6. An electrical connector for electrically connecting with a primary circuit board and a intermediate circuit board, comprising:

an insulative housing defining a first and a second side, each side abutting against one of the primary circuit board and the intermediate circuit board;

a space formed inside the housing and having an opening formed on the first side;

a first contact received in the housing, one end of the first contact extending beyond the first side of the housing for press-fitting into the intermediate circuit board, while the other end of the first contact extending into the space, and being a resilient and free end; and a second contact received in the housing, one end of the second contact extending beyond the second side of the housing for press-fitting in the primary circuit board, while the other end of the second contact extending into the space and electrically connecting with the free end of the first contact; wherein a first fastener passing through the primary circuit board and the insulative housing in a first direction and a second fastener passing through intermediate circuit board and terminating within the insulative housing in a direction transverse to the first direction.

7. The electrical connector as recited in claim 6, wherein shows the housing including two parts for receiving the first and second contact, respectively.

* * * * *